United States Patent [19]

Scheng

[11] Patent Number: 4,938,348

[45] Date of Patent: Jul. 3, 1990

[54] COMPACT BOW PACKAGE AND METHOD

[76] Inventor: Peter S. C. Scheng, 5 Ross Street, Toronto, Ontario, Canada, M5T 1Z8

[21] Appl. No.: 431,434

[22] Filed: Nov. 3, 1989

[51] Int. Cl.[5] ..... A41H 43/00; D04D 7/06

[52] U.S. Cl. ..... 206/303; 223/46; 428/4

[58] Field of Search ..... 206/303; 223/46; 428/4, 428/5

[56] References Cited

U.S. PATENT DOCUMENTS 3,174,886 3/1965 Miscovich ..... 428/4 X

*Primary Examiner*—William Price

*Attorney, Agent, or Firm*—Kirchstein, Ottinger, Israel & Schiffmiller

[57] ABSTRACT

A nested stack of pre-formed decorative bows are compactly packed and dispensed therefrom. Each bow has a plurality of curled free ribbon ends emanating from a central region. The curled ends of the bows engage and envelop one another, thereby minimizing "dead" space.

7 Claims, 1 Drawing Sheet

FIG. 1
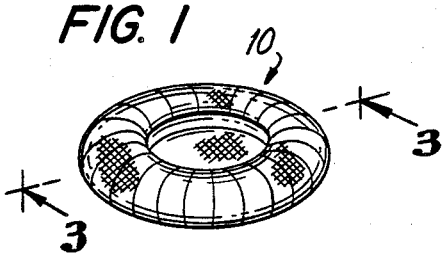
FIG. 2
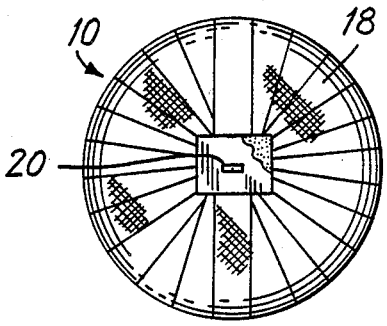
FIG. 3
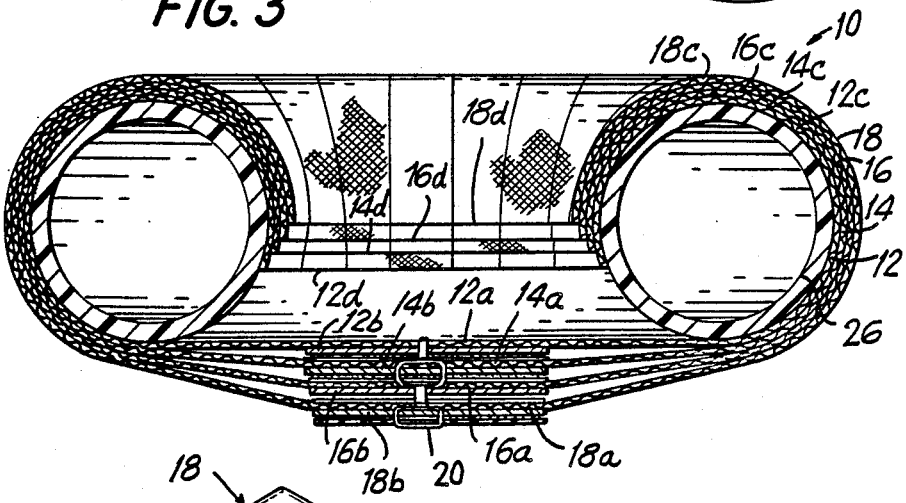
FIG. 4
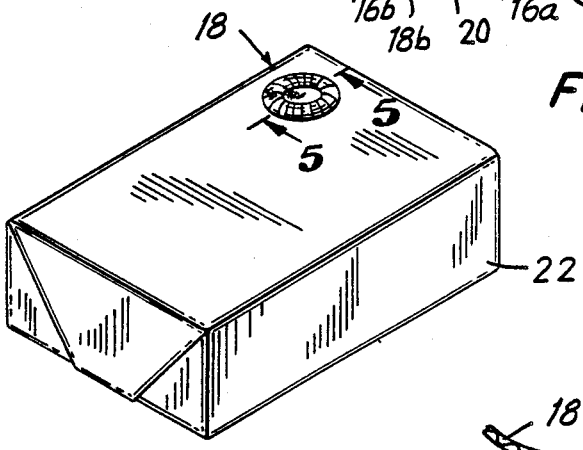
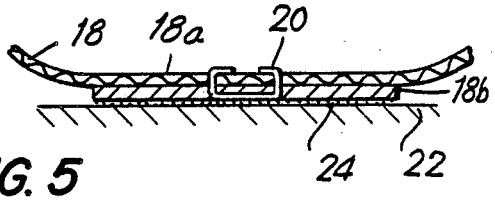
FIG. 5

COMPACT BOW PACKAGE AND METHOD

BACKGROUND OF THE INVENTION

1. Field of the Invention

This invention generally relates to an arrangement for, and a method of, compactly packaging bows and, more particularly, to a nested assemblage of pre-formed, ribbon-type bows, especially useful for decorating gift packages.

2. Description of Related Art

Gift packages are commonly decorated by adhesively securing thereto pre-formed ribbon bows. A typical existing pre-formed ribbon bow generally comprises a single ribbon which is looped and twisted on itself and formed into a three-dimensional floral configuration. Such a pre-formed bow tends to occupy a relatively large volume of space which, although desirable from an esthetic viewpoint, is not altogether satisfactory from an economical and shipping viewpoint, since fewer bows can be transported in a given amount of cargo space.

For these and other reasons, one or more flat ribbons are shipped in, and sold as, flat packages, thereby occupying very little cargo space and, hence, being very economical. Once the package is opened, a drawstring is pulled, thereby looping the one or more flat ribbons into a three-dimensional floral pattern. The resulting bow is then adhesively secured to the gift package.

Although the erection of a bow in situ on the gift package is a relatively simple procedure, many individuals simply do not want to be bothered with having to form the bow. Admittedly, it is simpler to deal with a pre-formed bow despite the higher inherent costs.

SUMMARY OF THE INVENTION

1. Objects of the Invention

It is a general object of this invention to overcome the aforementioned drawbacks in the art of decorative bows.

It is another object of this invention to compactly package many pre-formed bows in a minimal volume of space.

It is a further object of this invention to minimize bow shipping costs without having to resort to erecting a bow in situ on the gift package.

Another object of this invention is to provide an attractive, yet inexpensive, bow.

Still another object of this invention is to provide a novel dispenser for, and method of, dispensing many pre-formed bows.

2. Features of the Invention

In keeping with these objects, and others which will become apparent hereinafter, one feature of this invention resides, briefly stated, in an arrangement for, and a method of, compactly packaging bows. The invention comprises a plurality of decorative annular bows arranged in a nested stack. Each bow has a central region and a plurality of elongated, curled bow ribbons extending generally outwardly from the central region in a plurality of different directions, and terminating in free curled ribbon ends, said central regions of the bows overlying one another. The free curled ribbon ends of each bow at least partially envelop the free curled ribbon ends of the adjacent nested bows. The free curled ribbon ends of each bow together bound an opening which overlies the central region. Each bow is removable from the stack.

Each bow is secured to an object to be decorated, preferably by the provision of an adhesive layer applied over a backing sheet that is connected to a respective central region. A peel-off tab is juxtaposed with each adhesive layer in order to prevent a respective adhesive layer in the nested stack from adhering to an adjacent nested bow.

An annular support, e.g. a rigid ring, is positioned within the stack. The ring acts as a shaper and maintains the bows in the stack in a predetermined annular configuration.

Thus, in accordance with this invention, many pre-formed bows are compactly packaged in a minimum volume of space. By overlapping the free curled ribbon ends of each bow, there is no "dead" space, thereby more efficiently utilizing available cargo space in transport. The nested stack of bows can be sold to a consumer who may remove each bow one at a time to decorate one or more gift objects. Alternatively, a retailer can dispense one or more bows to the consumer without occupying too much shelf space.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a front perspective view of a nested stack of bows according to this invention;

FIG. 2 is a bottom view of the stack of FIG. 1;

FIG. 3 is an enlarged sectional view taken on line 3—3 of FIG. 1;

FIG. 4 is a front perspective view on a reduced scale of one bow removed from the stack of FIG. 1 adhesively secured to a gift package; and FIG. 5 is an enlarged view taken on line 5—5 of FIG. 4.

DETAILED DESCRIPTION OF THE PREFERRED EMBODIMENT

Referring now to the drawings, reference numeral 10 generally identifies in its entirety a compact bow package or nested stack comprised of a plurality of generally annular decorative bows which, as best shown in FIG. 3, are respectively identified by reference numerals 12, 14, 16, 18. It will be expressly understood that a stack 10 of four bows was selected for convenience of illustration and description because, in practice, many more than four such bows could be nested and, indeed, are nested in a single stack. In practice, it is preferred to nest between twelve and twenty such bows in a stack.

Each bow is formed of a plurality, for example, six, of ribbons of a predetermined length, e.g. on the order of nine inches. The midpoints of the ribbons for each bow are placed one on top of another and form a common center at a generally planar central region, e.g. **12*a*, 14*a*, 16*a* or 18*a***. The ribbons of each bow extend away from the generally planar central region in different directions and generally resemble a spider or starfish. Preferably, the ribbons extend along radial directions.

A backing sheet **12*b*, 14*b*, 16*b* or 18*b* underlies each central region. A staple 20** (see FIG. 2 or FIG. 5) or analogous connector interconnects a respective backing sheet to a corresponding central region, and effectively secures the ribbons of each bow in the aforementioned spider- or starfish-like configuration.

The opposite ribbon ends of each ribbon are curled initially upwardly above the respective central region, and thereupon downwardly toward, but terminating short of, the respective central region. All of the ribbon ends of each bow generally converge toward one another. As best shown in FIG. 3, the curled free bow ribbon ends 18c at least partly engage and envelop the curled bow ribbon ends 16c which, in turn, at least partly engage and envelop the curled bow ribbon ends 14c which, in turn, at least partly engage and envelop the curled bow ribbon ends 12c. There is very little, if any, "dead" space between the curled bow ribbon ends in the stack, thereby insuring a compact bow package.

The ribbon ends 18c together bound a generally circular opening 18d which overlies, and is elevated from, its respective central region 18a. The bow 18 is removable from the stack by being manually pulled from the stack. Typically, one grasps one of the curled free bow ribbon ends or the central region of the bow to be removed and pulls the bow off the stack. The bow can be pulled in an axial direction normal to the central region, or in a radial direction off to one side. The bows 18, 16, 14, 12 can be removed via their respective openings 18d, 16d, 14d, 12d, or through any one of the spaces bounded between adjacent curled bow ribbon ends.

Once removed, each bow can be used to adorn an object such as gift package 22. As shown in FIG. 5 for representative bow 18, an adhesive layer 24 applied over the backing sheet 18b is operative for adhesively securing the bow 18 to the package 22. A non-illustrated peel-off tab has first been peeled off from the adhesive layer 24 to expose the same.

An annular support such as rigid ring 26, preferably made of plastic or cardboard or analogous material, is positioned within the stack 10 and is operative for maintaining the bows therein in the illustrated annular configuration. The ring 26 is especially helpful when the number of bows in the stack has diminished.

Preferably, the ring 26 has a generally annular cross-section, and conforms to the curled shape of the bow ribbon ends.

Hence, the pre-formed bows of this invention can be very conveniently and easily removed from the stack 10 while, at the same time, being compactly maintained. The individual ribbons are constituted of conventional flat ribbon stock, preferably made of a synthetic material which can be easily curled and which maintains its shape after being curled.

It will be understood that each of the elements described above, or two or more together, also may find a useful application in other types of constructions differing from the types described above.

While the invention has been illustrated and described as embodied in a compact bow package and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An arrangement for compactly packaging bows, comprising:

a plurality of decorative, annular bows arranged in a nested stack, each bow having a central region and a plurality of elongated curled bow ribbons extending generally outwardly from the central region in a plurality of different directions and terminating in free curled ribbon ends, said central regions of the bows overlying one another, said free curled ribbon ends of each bow at least partially enveloping the free curled ribbon ends of adjacent nested bows, said free curled ribbon ends of each bow together bounding an opening overlying the central region, each bow being removable from the stack.

2. The arrangement according to claim 1; and further comprising means at the central region of each bow for securing each bow removed from the stack to an object to be decorated by the presence of the bow.

3. The arrangement according to claim 2, wherein the securing means includes a backing sheet and an adhesive layer thereon; and further comprising a peel-off tab overlying the adhesive layer.

4. The arrangment according to claim 1; and further comprising an annular support means within the stack, and operative for maintaining the bows in the stack in a predetermined annular configuration.

5. The arrangement according to claim 4; wherein the support means is a rigid ring.

6. A method of compactly packaging bows, comprising the steps of:

(a) arranging a plurality of decorative, annular bows in a nested stack;

(b) forming each bow with a central region and a plurality of elongated bow ribbons extending generally outwardly from the central region in a plurality of different directions and terminating in free ribbon ends;

(c) overlying the central regions of the bows, one on top of another;

(d) curling the bow ribbon ends so that the curled bow ribbon ends of each bow at least partially envelop the curled bow ribbon ends of adjacent nested bows; and (e) forming an opening between the free ribbon ends of each bow, each bow being removable from the stack.

7. The method according to claim 6, said arranging step being performed by positioning an annular support within the stack.

* * * * *

UNITED STATES PATENT AND TRADEMARK OFFICE

CERTIFICATE OF CORRECTION

PATENT NO. : 4,938,348

DATED : July 3, 1990

INVENTOR(S) : Peter S.C. Cheng

It is certified that error appears in the above-identified patent and that said Letters Patent is hereby corrected as shown below:

On the title page under item [19] and in item [76]:

Correct the spelling of the inventor's last name from "Scheng" to -- Cheng --.

Signed and Sealed this

Twentieth Day of August, 1991

*Attest:*

*Attesting Officer*

HARRY F. MANBECK, JR.

*Commissioner of Patents and Trademarks*